United States Patent [19]

Egami et al.

[11] Patent Number: 4,798,997

[45] Date of Patent: Jan. 17, 1989

[54] LIGHTING DEVICE

[75] Inventors: Hidemi Egami, Zama; Katsuo Saito, Yokohama; Hiroshi Satomura, Hatogaya, all of Japan

[73] Assignee: Canon Kabushiki Kaisha, Tokyo, Japan

[21] Appl. No.: 942,833

[22] Filed: Dec. 17, 1986

[30] Foreign Application Priority Data

| | | | |
|---|---|---|---|
| Dec. 26, 1985 | [JP] | Japan | 60-294458 |
| Apr. 18, 1986 | [JP] | Japan | 61-88318 |
| Jul. 29, 1986 | [JP] | Japan | 61-176738 |

[51] Int. Cl.[4] ..... H01J 65/04; H05B 6/80

[52] U.S. Cl. ..... 315/115; 315/116; 315/117; 315/248; 315/174; 313/13; 313/15; 355/69

[58] Field of Search ..... 315/248, 112, 115–117, 315/50, 174, 175, 344; 355/68, 69, 70; 313/13, 15

[56] References Cited

U.S. PATENT DOCUMENTS

| | | | |
|---|---|---|---|
| 2,267,821 | 12/1941 | Elenbaas | 315/112 |
| 2,975,330 | 3/1961 | Bloom et al. | 315/115 |
| 3,323,010 | 5/1967 | Bisjak et al. | 315/117 X |
| 3,331,977 | 7/1987 | Wainio | 313/34 |
| 4,101,807 | 7/1978 | Hill | 315/116 |
| 4,427,925 | 1/1984 | Proud et al. | 315/248 |
| 4,431,947 | 2/1984 | Ferriss et al. | 315/248 X |
| 4,451,765 | 5/1984 | Gray | 315/248 |
| 4,533,853 | 8/1985 | Hammond et al. | 315/117 |
| 4,533,854 | 8/1985 | Northrup | 315/117 |
| 4,645,974 | 2/1987 | Asai | 315/50 |

*Primary Examiner*—David K. Moore
*Assistant Examiner*—Mark R. Powell
*Attorney, Agent, or Firm*—Fitzpatrick, Cella, Harper & Scinto

[57] ABSTRACT

A discharge tube adapted to produce a light by an extraneous high frequency electromagnetic field is heated before discharge to thereby improve the rising-up of the discharge and achieve uniformization of emitted light. Further, the discharge tube is heated by an electrode which applies a high frequency electromagnetic field to the discharge tube.

21 Claims, 15 Drawing Sheets

LIGHTING DEVICE

BACKGROUND OF THE INVENTION

1. Field of the Invention

This invention relates to a lighting device in which a discharge tube, such as an electrodeless tube, is caused to emit light by a high frequency electromagnetic field being applied to the discharge tube from the outside thereof.

In particular, it relates to a lighting device in which a discharge tube of an elongated shape can be quickly brought into a uniform light emitting state and which is suitable for the exposure of an original in an original reading apparatus.

2. Related Background Art

Fluorescent lamps and halogen lamps have heretofore been widely used in original reading apparatuses and everyday illumination.

A fluorescent lamp produces visible light and when viewed from the viewpoint of the wavelength of its emitted light, it permits the wavelength to be selected by selection of the fluorescent material and thus, it is preferable as an illuminating source, but if a great current is applied to its filament to obtain a great quantity of light, the filament is immediately burnt out and the quantity of light obtained is low. Also, when a current is caused to flow in the filament, the excited gas in the discharge tube accelerates the deterioration of the filament and thus, the service life of the filament itself is short.

As compared with a fluorescent lamp, a halogen lamp can provide a great quantity of light, but produces a great deal of light other than in the range of visible light, as shown in FIG. 28 of the accompanying drawings. That is, a halogen lamp produces a great deal of light which is not used in an apparatus utilizing chiefly the wavelength range of about 400–800 nm, such as an original reading apparatus or a copying apparatus having a photosensitive medium and therefore is low in power efficiency. Also, a halogen lamp produces light by converting electrical energy into heat and therefore suffers from great heat generation.

In view of such problems, Japanese Laid-Open Patent Applications Nos. 98457/1980 and 249240/1985 disclose applying energy to the discharge tube from the outside thereof by utilizing the discharge phenomenon as in a fluorescent lamp, and ensuring much higher brightness and much longer service life than a fluorescent lamp.

FIG. 27 of the accompanying drawings is a cross-sectional view of an example of such a light source. Reference numeral 64 designates a lamp having a fluorescent material 63 applied to the inner surface thereof and having mercury and inactivated gas enclosed therein. The lamp 64 is formed with a cylindrical portion 67 protruding so as to include a transformer 62. The transformer 62 comprises a core 66 and a coil 65, and the ends of the coil 65 wound around the core 66 are connected to a high frequency lamp source 61.

A high frequency voltage is applied from the high frequency lamp source 61 to the coil 65, whereby a high frequency electromagnetic field is produced around the coil 65. The electrical energy of this electromagnetic field excites the mercury gas in the lamp 64, and the ultraviolet rays of the mercury produced by this excitation are changed into visible light by the fluorescent material 63 applied to the surface of the lamp 64.

Such a light source utilizes the discharge phenomenon and can provide light of an appropriate wavelength range by the selection of the fluorescent material, and does not have any filament which emits heat electrons, and utilizes electromagnetic field energy applied by an electrode provided in contact with the outer wall of the discharge tube, and thus permits application of a great electric power thereto, is of high brightness and enjoys a long service life because the electrode is not exposed to the excited gas in the discharge tube.

Although such light source has merits of high brightness, long service life and good power efficiency because of its being appropriate to the wavelength range, it has suffered from the problem of a bad rising-up characteristic.

That is, even if high frequency power is supplied, much time is required before the lamp assumes a stable light-emitting condition, and this has led to the occurrence of the phenomenon that particularly in the worst case, the discharge does not occur over the entire discharge tube, but only partially. Such phenomenon is conspicuous where the discharge tube is of an elongated shape.

SUMMARY OF THE INVENTION

It is an object of the present invention to solve the aforementioned problem of the rising-up of the device during its use and to provide a lighting device which ensures stable light emission to be obtained in a short time.

It is a further object of the present invention to accomplish an improvement in the rising-up, by means of a simple construction.

It is still a further object of the present invention to provide a lighting device provided with an elongated discharge tube which has high brightness and a long service life and is excellent in the rising-up characteristic.

Further objects of the present invention will become apparent from the following detailed description.

DESCRIPTION OF THE PREFERRED EMBODIMENTS

Figure 1:
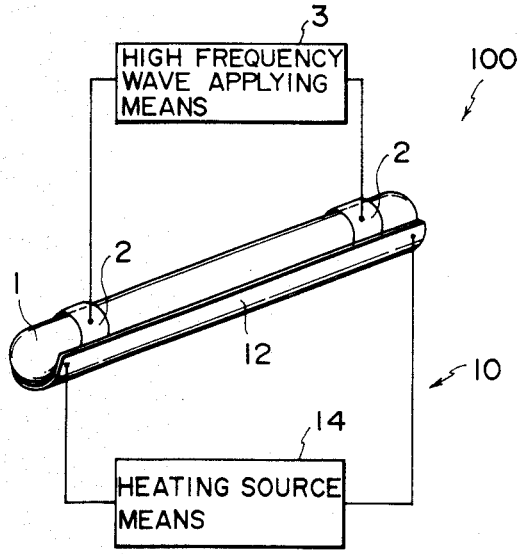
FIG. 1 is a perspective view of an embodiment of the present invention.

Some embodiments of the present invention will hereinafter be described in detail with reference to the drawings, throughout which functionally similar members are given similar reference numerals.

The inventors have investigated the causes of the aforementioned problems.

It is preferable that such a device be used with impedance matching kept on the discharge tube side and the output side for applying a high frequency electromagnetic field to the discharge tube.

However, it has been found that when the discharge tube is cold, the reactance in the discharge tube is irregular and with such irregularity of the reactance, there is produced irregularity of the vapor pressure of the internal gas (for example, Hg). This tendency is particularly marked where the discharge tube is of an elongated shape, because it is difficult for the internal gas to circulate, and due to the irregularity of the impedance in the discharge tube, matching of impedance is not kept between the discharge tube side and the output side when observed in individual portions and therefore, the electromagnetic field energy is reflected by the tube wall and little of it is input to the interior of the tube. It has been found that the discharge phenomenon also depends on the vapor pressure of the internal gas such as mercury and therefore, even if discharge is effected, the irregularity of the vapor pressure gives rise to irregularity in the quantity of light.

The present invention is based on such findings.

Figure 2:
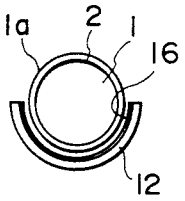
FIG. 2 is a cross-sectional view of the FIG. 1 embodiment.

FIG. 1 is a perspective view of an embodiment of the present invention, and FIG. 2 is a cross sectional view of the FIG. 1 embodiment.

A lighting device according to this embodiment is provided with a discharge tube (lamp) 1 adapted to emit light by means of a high frequency electromagnetic field, electrodes 2 disposed on the outer wall of the discharge tube, and high frequency wave applying means 3 for applying a high frequency wave to the electrodes.

The discharge tube 1 is formed by applying a fluorescent material into an elongated glass tube usually made of soda-lime glass or pyrex glass, and a discharge starting material such as mercury (Hg) and an inactivated gas such as argon (Ar) are enclosed in the discharge tube. Also, a plurality of electrodes 2 formed of a conductor such as copper or stainless steel which is less subject to oxidation are disposed on or near the opposite ends of the discharge tube 1. These electrodes may be provided in slightly spaced apart relationship with the outer wall of the discharge tube so as to permit an insulating sheet to be interposed therebetween, but usually it is preferable that they are provided in intimate contact with the outer wall of the discharge tube, because this reduces the loss of the power of the high frequency electromagnetic field applied to the discharge tube.

Figure 3:
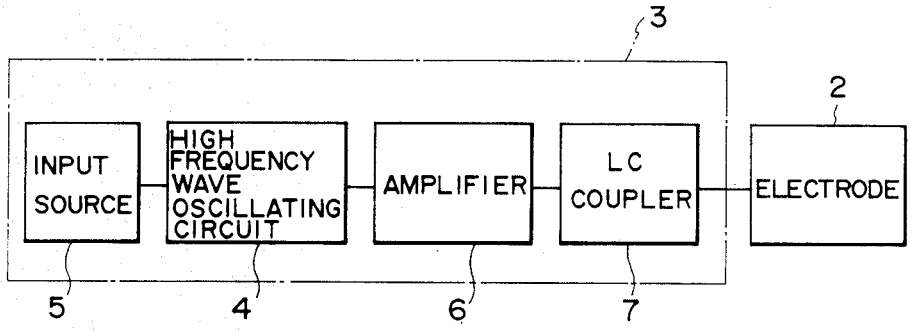
FIG. 3 is a block diagram illustrating an embodiment of the present invention.

A high frequency voltage is applied to the electrodes 2 by the high frequency wave applying means 3. The high frequency wave applying means 3 may be of any construction, but for example, as illustrated in FIG. 3, it may have a high frequency wave oscillating circuit 4 for oscillating a high frequency voltage, an input source 5 for the high frequency wave oscillating circuit 4, an amplifier 6 for amplifying the high frequency voltage from the high frequency wave oscillating circuit 5 to a predetermined voltage, and an LC coupler 7 for matching the high frequency voltage from the amplifier 6 with the impedance of the discharge tube 1.

When a high frequency voltage is applied from the high frequency wave applying means 3 of such construction to the electrodes 2, the mercury gas in the discharge tube becomes excited by the high frequency electromagnetic field and produces ultraviolet rays. The ultraviolet rays act on the fluorescent material applied to the inner wall of the discharge tube and cause a light of the visible light range to be produced.

More specifically describing, during the normal lit state, a high frequency voltage of a frequency of 8 MHz–10 MHz and of a voltage level of 200 V or higher at Vpp and in which the duty ratio of the high frequency pulse is 5–90% is applied from the high frequency wave applying means to the discharge tube having a diameter of 5–30 mm and a length of 300 mm and in which several Torr of Ar and Hg as the discharge starting material are enclosed. Further, discharge tube heating means 10 for heating the tubular wall of the discharge tube 1 is disposed around the discharge tube 1. In the present embodiment, the discharge tube heating means 10, as shown in FIGS. 1 and 2, has a heating member 12 extending substantially over the full length of the discharge tube 1 and disposed around substantially one-half of the circumference of the discharge tube 1 except for a light-emitting aperture portion 1*a*. The heating member 12 may be of any structure, and may be, for example, a sheet-like electric heater having a nichrome wire or the like embedded in insulative resin or the like, or a sheet-like heater such as a sheet-like ceramics heater utilizing the dielectric loss of ceramics. The heating means 10 is also provided with AC or DC heating source means 14 for supplying electric power to the heater 12.

Figure 4:
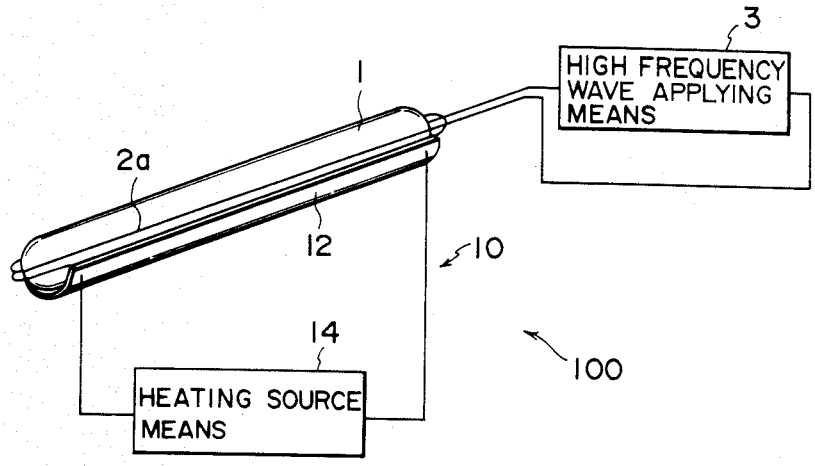
FIG. 4 is a perspective view of another embodiment of the present invention.

FIG. 4 shows another embodiment of the present invention in which a coil type electrode 2*a* constructed by winding a coil around a discharge tube along the lengthwise direction thereof over several turns is disposed on the outer wall of the discharge tube 1.

The lighting device of FIG. 4, as compared with the lighting device of FIG. 1, has a feature that the electrode extends along the lengthwise direction and energy is input along the entire length of the discharge tube and therefore a greater electric power can be applied to the electrode and a greater quantity of light can be obtained and excellent uniformity of the quantity of light in the lengthwise direction is provided. Such lighting device is preferable for use in an apparatus such as an original reading apparatus in which a great quantity of light uniform in the lengthwise direction is desired.

In the lighting device having a discharge tube of such a construction, a voltage is applied from the heating source means 14 to the heating member 12 before the device is turned on. By means of providing such a standby state, that is, by a predetermined turn-on preparation time elapsing, the tubular wall of the discharge tube is heated and the estropy in the discharge tube increases and the atoms and electrons of the mercury and inactivated gas repeat vibration, and the irregularity of the impedance and the irregularity of the mercury vapor pressure in the discharge tube are eliminated, and therefore, the partial mismatch between the discharge tube and the output side is eliminated and electromagnetic field energy is input into the discharge tube in a moment. Further, the kinetic energy of mercury increases and this provides a readily excitable state.

Such a heating temperature poses no problem if it is at such a degree of level that the impedance irregularity and vapor pressure irregularity in the discharge tube are eliminated, and actually it differs depending on the shape of the tube, but a heating temperature of the order of 20° C.–40° C. can eliminate said irregularities to a practically negligible degree even if the discharge tube is of an elongated shape.

Figure 5:
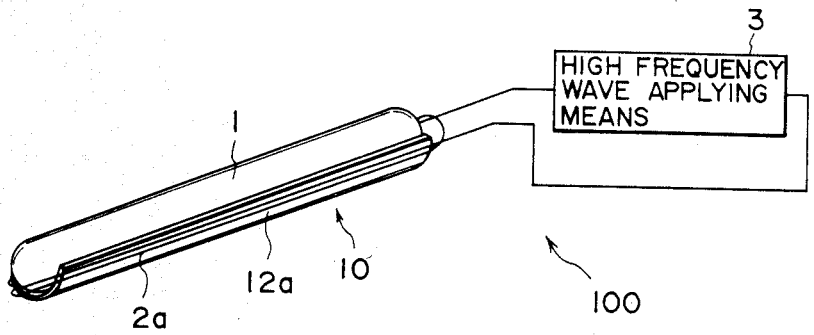
FIG. 5 a perspective view of still another embodiment of the present invention.
Figure 6:
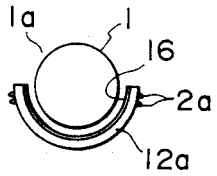
FIG. 6 is a cross-sectional view of the FIG. 5 embodiment.

Further, according to another embodiment of the present invention, in a lighting device using said coil type discharge tube described in relation to FIG. 4, as shown in FIGS. 5 and 6, the discharge tube heating means 10 has a heating member 12*a* comprising, like the heating member 12, an electrically conducting plate extending in proximity to the circumference of the discharge tube substantially over the full length of the discharge tube and surrounding the outer wall of the discharge tube, and only the light-emitting aperture portion 1*a* is opened. Also, a coil electrode 2*a* constructed around the discharge tube and covered with an insulating member is provided in intimate contact with the outer peripheral surface of the aforementioned electrically conducting plate 12*a*. The coil wound on the electrically conducting plate 12*a*, according to another embodiment, may be a coil discrete from the coil of the electrode (not shown).

In the above-described construction, when a high frequency voltage is applied from the high frequency wave applying means 3 to the coil 2*a*, a magnetic field is produced by a current flowing through the coil 2*a*, whereby an eddy current is produced in the electrically conducting plate 12*a*. This eddy current heats the electrically conducting plate 12*a* and thus, heats the discharge tube 1 disposed in proximity to the heated electrically conducting plate, i.e., the heating member 12*a*.

The frequency of the high frequency voltage supplied to the coil 2*a* wound on the heating member 12*a* is smaller than the frequency of the high frequency voltage by which the discharge tube 1 is turned on. For example, when the discharge tube is to be turned on, a high frequency voltage of frequency 10 MHz and voltage level Vpp 2 KV is applied from the high frequency wave applying means to the discharge tube coil electrode, as described above, but when the discharge tube is to be pre-heated, a high frequency voltage of frequency 10 MHz and voltage level Vpp 0.5 KV is applied to the coil electrode or the coil of the heating means.

According to the present embodiment, prior to the discharge tube 1 being turned on, a high frequency voltage of frequency $10^4$–$10^6$ Hz which is smaller than the frequency of the high frequency voltage by which the discharge tube 1 is turned on is applied from the high frequency voltage applying means 3. In such a standby state, that is, by a predetermined preparation time elapsing, the tubular wall of the discharge tube is heated by the heating member 12*a* and at the same time, a high frequency voltage of lower frequency is also applied to the discharge tube itself, and the atoms and electrons of the mercury and inactivated gas in the discharge tube repeat vibration and thus, the discharge tube assumes its state immediately before discharge is started. Again in the present embodiment, it is necessary that the heating member 12*a* be controlled so that the tubular wall is kept at 20° C.–40° C., and for this purpose, the frequency and/or the voltage of the high frequency wave applying means 3 during the standby state is suitably controlled.

In any of the embodiments of FIGS. 1, 2, 4, 5 and 6, the heating member 12, 12*a* constituting the heating means can also be used as the reflector of the discharge tube by providing a member 16 of high reflectivity such as a metallic thin film on the inner surface thereof, and in the case of the heating member 12*a* comprising an electrically conducting plate, by using a material of high reflectivity for visible light and of low resistance such as aluminum or stainless steel for the electrically conducting plate itself. However, in the embodiment of FIG. 6, this is not preferable because the distance between the electrode and the discharge tube becomes great. Further, in the embodiment of FIG. 6, it is preferable that the electrically conducting plate 12*a* be so thin as to to hamper the application of an electromagnetic field to the discharge tube.

Still another embodiment will now be described.

Figure 7:
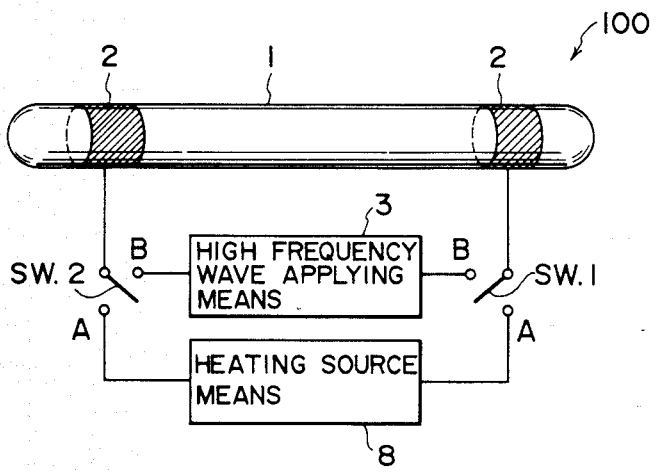
FIG. 7 is a schematic view of yet still another embodiment of the present invention.

FIG. 7 schematically shows an embodiment of the present invention in which the shape of the electrodes is the same as that in the embodiment of FIG. 1.

Before lighting device 100 is used, that is, during standby, switches Sw.1 and Sw.2 are in contact with their respective terminals A and the heating source 8 heats the electrodes 2, whereby the gas in the discharge tube is heated to about 30° C.

When a light-on signal is applied in this state, the switches Sw.1 and Sw.2 come into contact with their respective terminals B and a high frequency wave is applied to the electrode. The mercury gas in the discharge tube becomes excited by a high frequency electric field, and the ultraviolet rays thus produced are changed into visible light by a fluorescent material.

Figure 8:
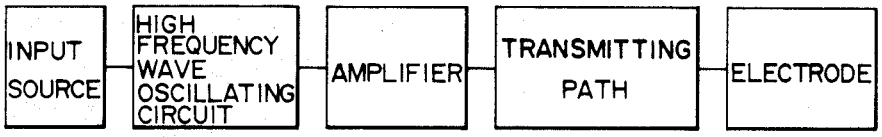
FIG. 8 is a block diagram of a further embodiment of the present invention.

FIG. 8 is a block diagram illustrating the epitome of the present embodiment. Input power is applied from an input source to a high frequency wave oscillating circuit to produce a high frequency wave, and then the voltage is amplified by an amplifier circuit and applied to an electrode through a transmitting path.

The above-described high frequency wave applying means comprises an input source, a high frequency wave oscillating circuit and an amplifier circuit.

Such use of the electrode also as the heating member of the discharge tube preferably eliminates the necessity of providing the heater 12 and the electrically conducting plate 12*a*. In such a lighting device wherein the electrode is disposed in direct contact with the outer wall of the discharge tube or in indirect contact therewith with an insulating sheet interposed therebetween, the electrode is of a certain degree of size and therefore, there is no problem in using the electrode to effect such a degree of heating as to eliminate impedance irregularity and vapor pressure irregularity.

More preferable embodiments will now be described with reference to FIGS. 9 to 15.

Figure 9:
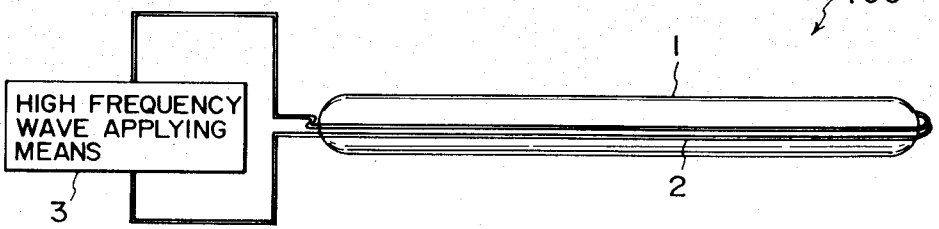
FIG. 9 is a schematic view of still a further embodiment of the present invention.

FIG. 9 shows an embodiment in which the shape of the electrode in the embodiment of FIG. 4 is applied. This shape of the electrode is not restrictive, but the shape shown in FIG. 1 and other shapes are also applicable.

Figure 10:
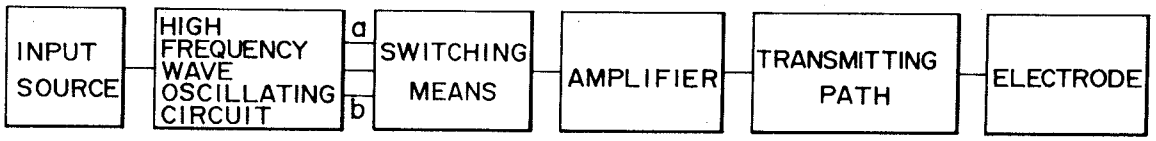
FIG. 10 is a block diagram of yet a further embodiment of the present invention.
Figure 12:
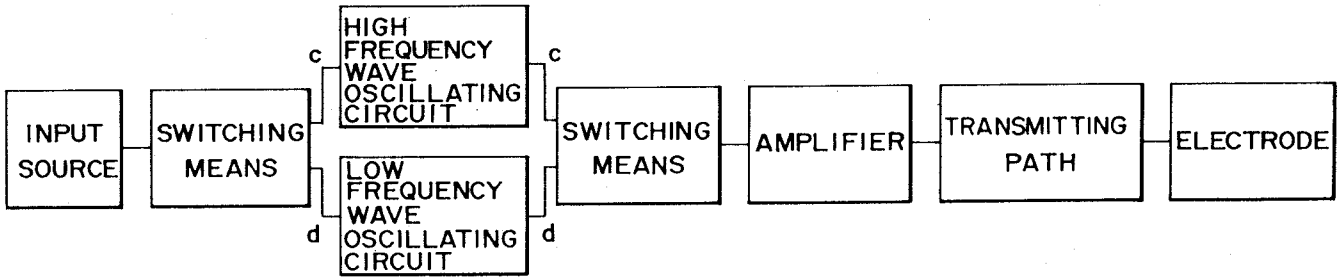
FIG. 12 is a block diagram of another embodiment of the present invention.
Figure 14:
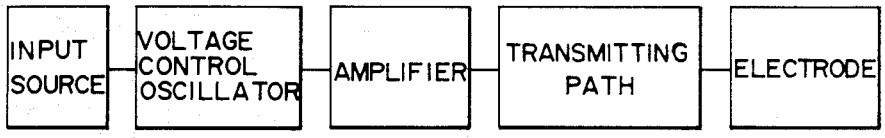
FIG. 14 is a block diagram of still another embodiment of the present invention.

FIGS. 10, 12 and 14 are block diagrams of further embodiments illustrating the epitome of the FIG. 4 embodiment.

The embodiment of FIG. 10 will first be described. An input power is applied from an input source to a high frequency wave oscillating circuit. The high frequency wave oscillating circuit is provided with a terminal a for outputting a high frequency wave of a sufficiently high voltage to cause the discharge tube to discharge through an amplifier circuit, and a terminal b for outputting the same frequency of a voltage insufficient to cause the discharge tube to discharge.

During standby, the terminal b and the amplifier circuit are in conductive state and a voltage insufficient to cause the discharge tube to discharge is applied to the electrode through a transmitting path, and the discharge tube does not discharge and thus, the electrode is heated and the gas in the discharge tube is regular at 30° C. and the mercury is in its readily excitable state.

When a light-on signal is input in this state, the terminal a and the amplifier circuit are rendered conductive by switching means, and a sufficiently high voltage to enable the discharge tube to discharge is applied to the electrode and the discharge tube assumes its discharging state.

Figure 11:
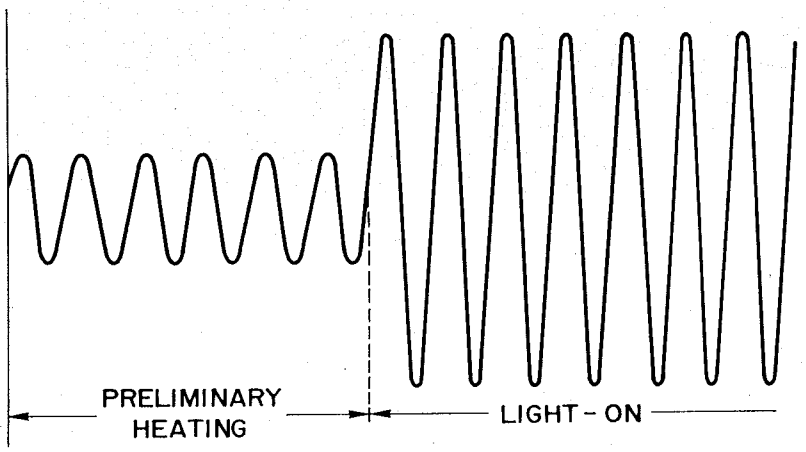
FIG. 11 is shows the wave form optical in the FIG. 10 embodiment.

In FIG. 11 is shown the output applied to the electrode. As shown, during standby, the voltage is small and is great from light-on, and by such a change in the state of the voltage, the heating state and the light-on state can be changed over.

In this embodiment, as in the embodiments of FIGS. 12 and 14 which will be described later, the gas in the discharge tube is free of irregularity and further in a readily excitable state and therefore, the rising-up time till discharge is of course short and the heating source in the embodiment of FIG. 7 is not required, and before the use of the lighting device, it is stably turned on by a low heating voltage, and during the use of the lighting device, it is stably turned on by a great voltage, whereby further compactness and reduced cost of the device can be achieved.

Further, heating is effected substantially uniformly over the length of the discharge tube and therefore there is no temperature irregularity in the lengthwise direction, and substantially simultaneously with discharge, a uniform distribution of emitted light is provided in the lengthwise direction, and this is particularly preferable in the original exposure light source of an original reading apparatus.

Another embodiment will now be described with reference to the block diagram of FIG. 12.

During standby, an output of a sufficiently low frequency of the order of several tens of KHz to several hundred KHz is applied to the electrode through a terminal d, which does not effect discharge, and the discharge tube is in its heated condition (about 30° C.), and when a light-on signal is input in this condition, switching means renders a terminal c conductive and an output of a sufficiently high frequency to cause the discharge tube to discharge is applied to the electrode, whereby the discharge tube becomes turned on.

According to this embodiment, discharge is controlled by frequency and therefore, it is possible to adopt a high output voltage for preliminary heating and the heating capability becomes higher.

Figure 13:
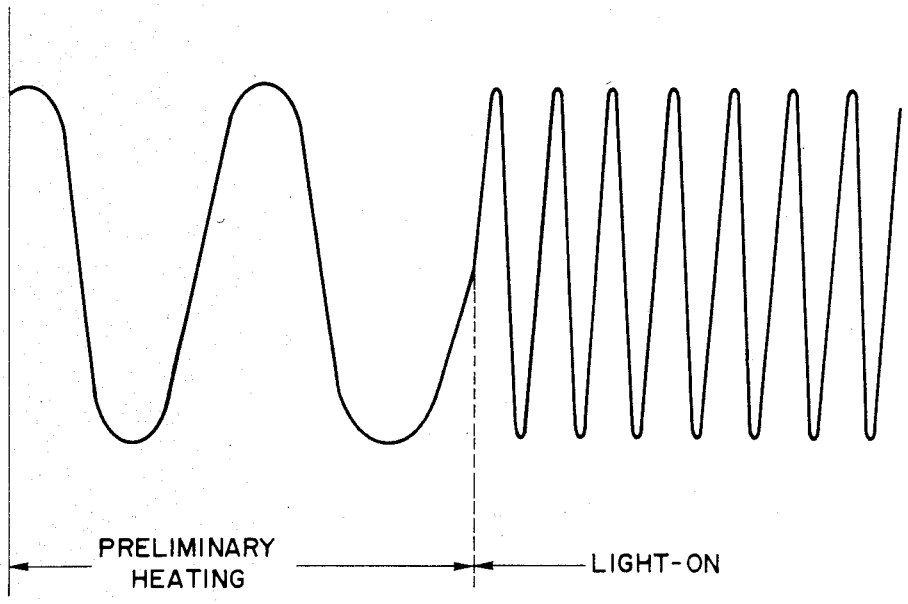
FIG. 13 shows the wave form applied in the FIG. 12 embodiment.

In FIG. 13 is shown the output applied to the electrode. As shown, during preliminary heating, the frequency is set to a level sufficiently lower than during light-on, whereby the heating state and the discharging state can be changed over.

Still another embodiment will now be described with reference to the block diagram of FIG. 14.

During preliminary heating, a low voltage is input from an input source to a voltage control oscillator. The voltage control oscillator has its output frequency varied with a variation in the input voltage and can control both of frequency and voltage.

When a light-on signal is input, a high voltage is input from the input source to the voltage control oscillator and an output of a sufficiently high voltage to cause the discharge tube to discharge and of a sufficiently high frequency is applied to the electrode, and the discharge tube assumes its discharging state.

Figure 15:
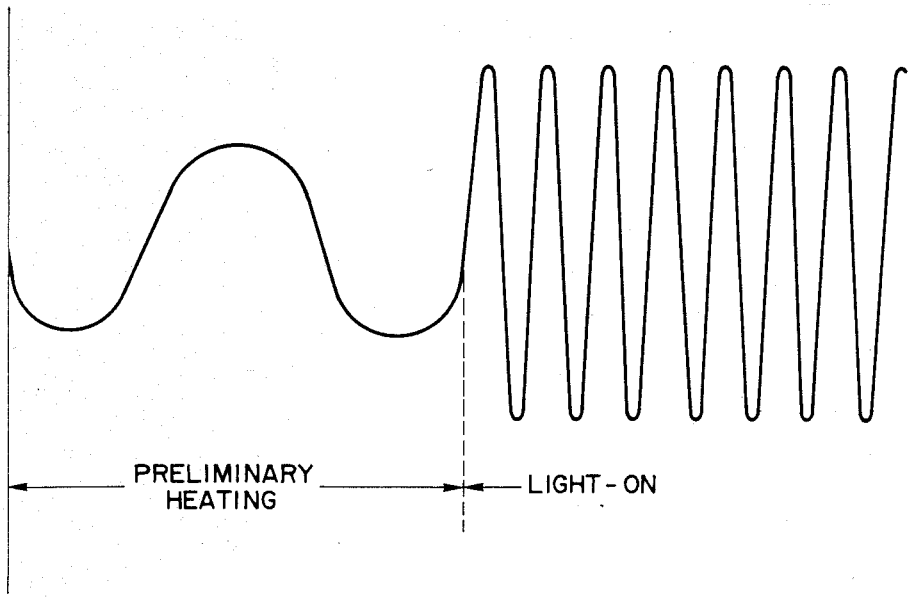
FIG. 15 shows the wave form applied in the FIG. 14 embodiment.

In FIG. 15 is shown the output applied to the electrode.

As shown, during preliminary heating, both of voltage and frequency are made low to thereby much more ensure the discharge tube not to discharge during preliminary heating.

Thus, during standby, the current or the duty ratio may be made smaller than during the use or these may be combined.

In the foregoing embodiments, it has been described that discharge is not effected during standby, but the discharge tube may be in a partially discharging state instead of its completely discharging state.

That is, when the level of the high frequency power is in the vicinity of the boundary at which discharge does or does not take place, the discharge of the discharge tube is unstable and the discharge tube does not fully discharge but partially discharges or is turned off. The level of heating by the high frequency wave applying means during standby may be rendered to such degree.

Figure 16:
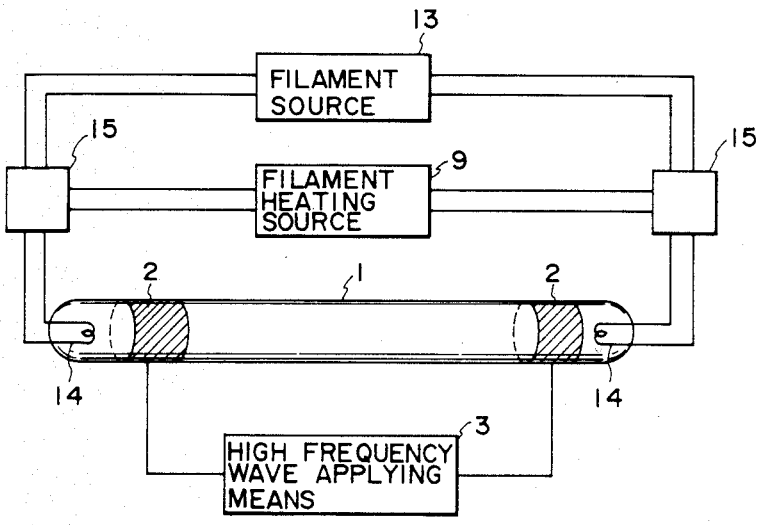
FIG. 16 is a schematic view showing yet another embodiment of the present invention.

FIG. 16 schematically shows yet still another embodiment.

The discharge tube has filaments at the ends thereof, and during preliminary heating, such a degree of current that the discharge tube does not discharge is applied to the filaments by a filament heating source 9.

When a light-on signal is input, a filament source 13 is rendered conductive by switching means 15 and a sufficient current to cause the discharge tube to discharge is applied to the filaments 14, and the discharge tube discharges, whereupon the filament source 13 is turned off and a high frequency wave lamp source is turned on to apply a high frequency wave to the electrode and maintain the discharging state.

Figure 17:
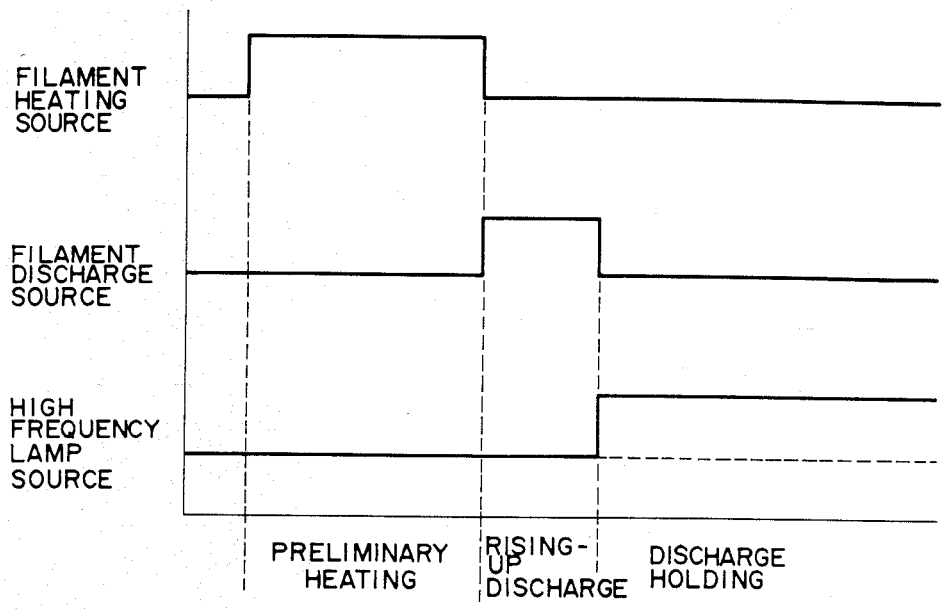
FIG. 17 is a timing chart illustrating the FIG. 16 embodiment.

FIG. 17 shows a timing chart of this embodiment.

In this embodiment, the discharge tube has filaments therein as described above, and preliminary heating is effected by the filaments and further, rising-up discharge is effected by the filaments in the discharge tube. According to such a construction, the rising-up time is substantially the same as that of a fluorescent lamp. The filaments are used only during the initial period and therefore have a longer service life than fluorescent lamps, but they still suffer from the deterioration by the excited gas and therefore, the embodiments of FIGS. 1 to 15 are more preferable.

Figure 18:
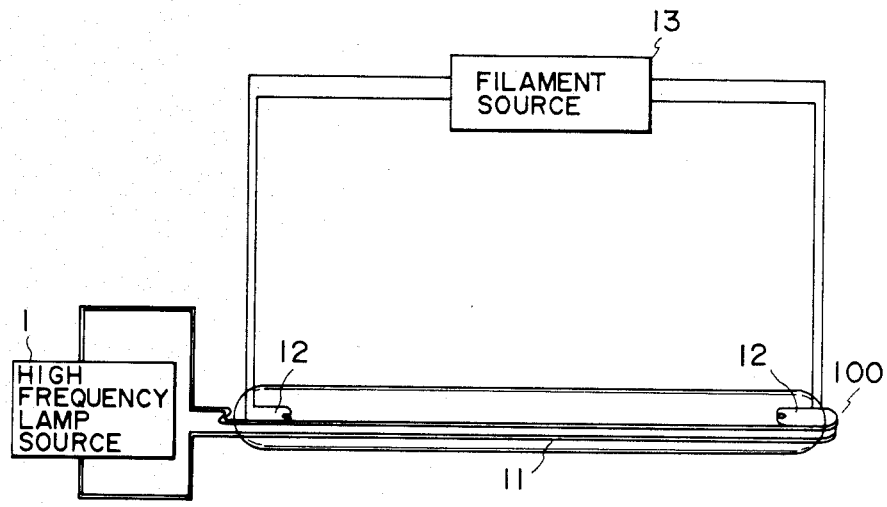
FIG. 18 is a schematic view of a further embodiment of the present invention.

FIG. 18 schematically shows yet another embodiment. This embodiment has no filament heating source and the filament source 13 serves to effect both heating and rising-up discharge.

Figure 19:
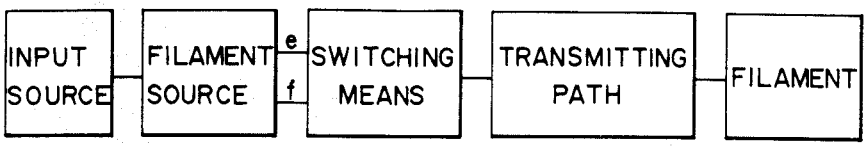
FIG. 19 is a block diagram of still a further embodiment of the present invention.

FIG. 19 is a block diagram illustrating the epitome of this embodiment.

The filament source is provided with a terminal e for outputting a sufficient current to cause the discharge tube to discharge and a terminal f for outputting such a degree of current that the discharge tube does not discharge.

During standby, a low current which does not cause the discharge tube to discharge is applied from the terminal f to the filaments to effect preliminary heating.

When a light-on signal is input, the terminal e is rendered conductive by switching means, and a sufficient current to cause the discharge tube to discharge is applied to the filaments to effect rising-up discharge. When the discharge tube assumes its discharging state, the filament source is turned off and the discharging state is maintained by the high frequency wave lamp source.

Figure 20:
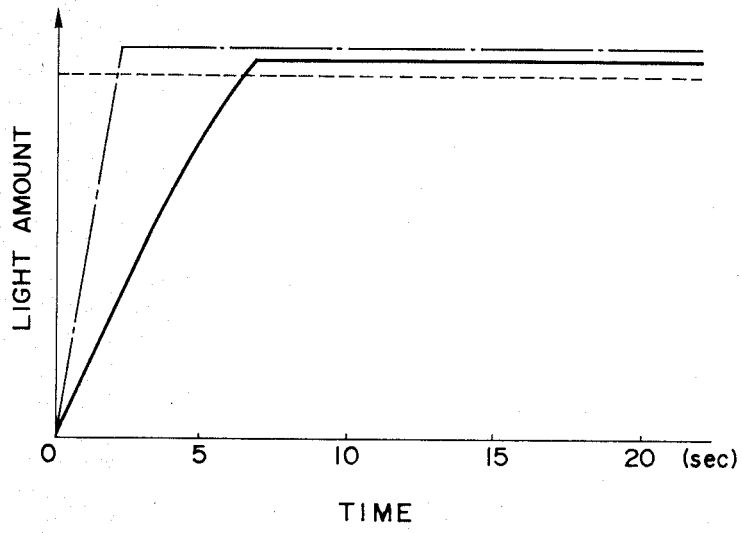
FIG. 20 is an illustration for the present invention.

FIG. 20 shows the effect of the present invention.

In FIG. 20, the solid line indicates the rising-up characteristic when preliminary heating is not effected, and the dot-and-dash line indicates the rising-up characteristic when preliminary heating (30° C.) is effected.

It is seen that when preliminary heating is effected, the rising-up characteristic becomes about 1 per three minutes and is very much shortened.

It has also been found that when preliminary heating is effected, discharge immediately becomes stable.

Description will now be made of a high frequency wave used for discharge.

The inventors have carried out an experiment taking brightness and increase in power efficiency into account and have found that $10^6$–$10^8$ Hz is preferable. Further, in the aforedescribed embodiments of FIGS. 6 and 8, the frequency used for preliminary heating may be $10^8$ Hz or more, but may preferably be $10^6$ Hz or less when power efficiency, noise, increase in heating efficiency, etc., are taken into account.

This preliminary heating, if it is 20° C.–40° C., can eliminate any impedance irregularity and vapor pressure irregularity of the discharge tube, but may be 40° C. or higher when it is desired to further enhance the excited state of the discharge starting agent such as mercury and further quicken the rising-up.

A further embodiment will now be described.

To shorten the rising-up time, it would occur to mind to apply a great high frequency power to the electrode and turn on the discharge tube, and thereafter reduce the high frequency power.

In such case, the high frequency power during the initial light-on is great and therefore, the influence of the impedance irregularity in the discharge tube is great. That is, in spite of a great high frequency power being applied to the discharge tube, the electromagnetic field energy is reflected by the tube wall due to the nonconformity between the discharge tube side and the output side resulting from impedance irregularity and is not input into the discharge tube.

Figure 21:
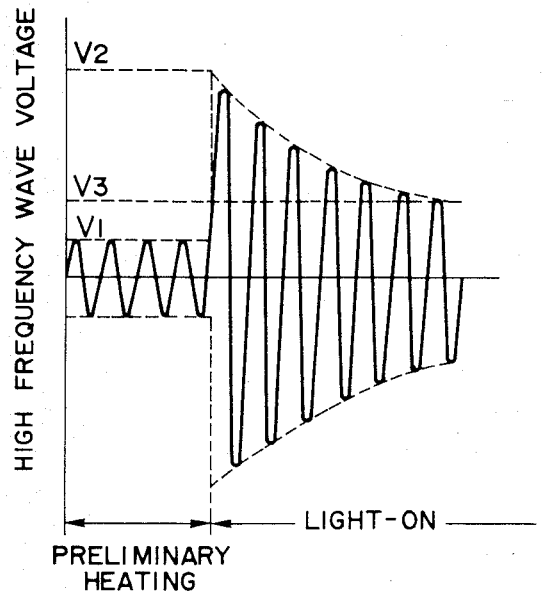
FIG. 21 shows the wave form applied in still a further embodiment of the present invention.

FIG. 21 shows the wave form of a high frequency voltage applied to the electrode in another embodiment. The shape of the electrode may be that of FIG. 1, that of FIG. 4 or other shape.

That is, during the standby of the device, a low high frequency voltage $V_1$ insufficient for the discharge tube to discharge completely is applied to the electrode. When a light-on signal is then applied, a great high frequency voltage $V_2$ is applied to the electrode, and after the discharge tube is turned on, the high frequency voltage is reduced to $V_3$. This voltage change may be effected either continuously or stepwise.

The increase or decrease in this high frequency power is not restricted to voltage, but may be in current, duty ratio or frequency, and where duty ratio is changed, there is no possibility of the impedance fluctuating on the output side, and this is preferable.

Also, when it is desired to increase the heating temperature, a heater or the like may be used as shown in FIGS. 1 and 4.

Description will now be made of an embodiment in which the high frequency power hitherto described is fluctuated.

Figure 22:
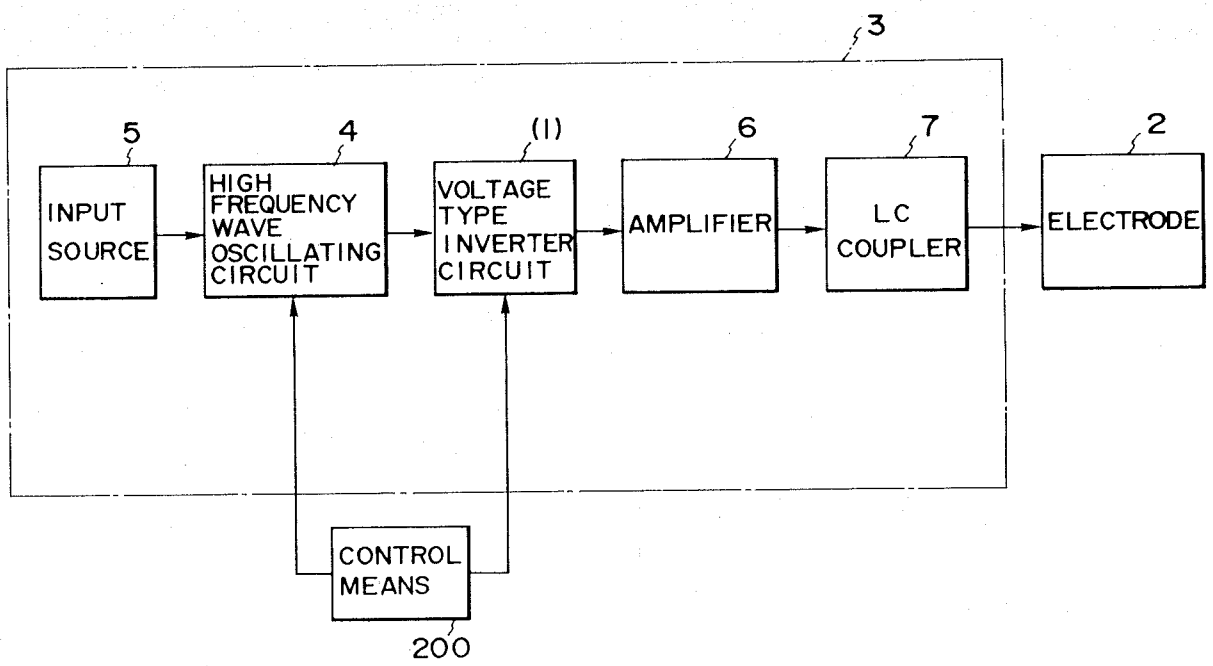
FIGS. 22, 23 and 24 are block diagrams of further embodiments of the present invention.

FIG. 22 is a block diagram showing a case where the high frequency voltage is fluctuated.

A bridge voltage type inverter circuit 11 subjected to PWM control well known to those skilled in the art is controlled with a high frequency wave oscillating circuit 4 by control means 200 such as a microprocessor.

Figure 23:
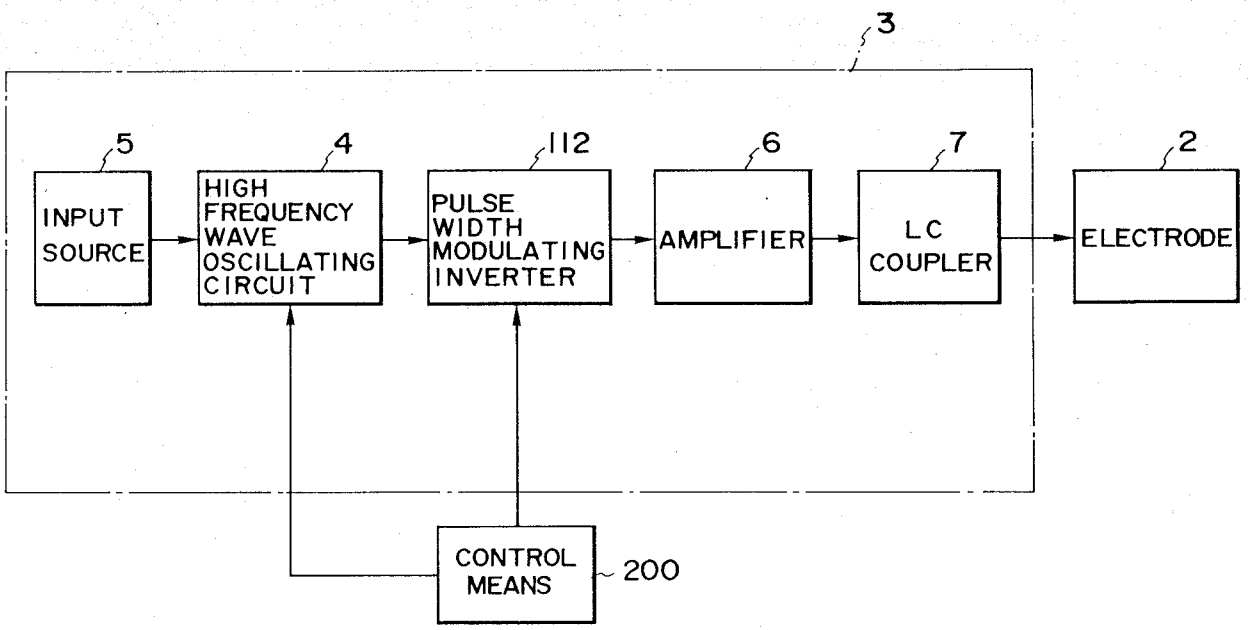

FIG. 23 is a block diagram showing a case where the duty ratio is fluctuated.

A pulse width modulating inverter circuit 112 well known to those skilled in the art which is provided between a high frequency wave oscillating circuit 4 and an amplifier circuit 6 is controlled with the high frequency wave oscillating circuit 4 by control means 200 such as a microprocessor.

Figure 24:
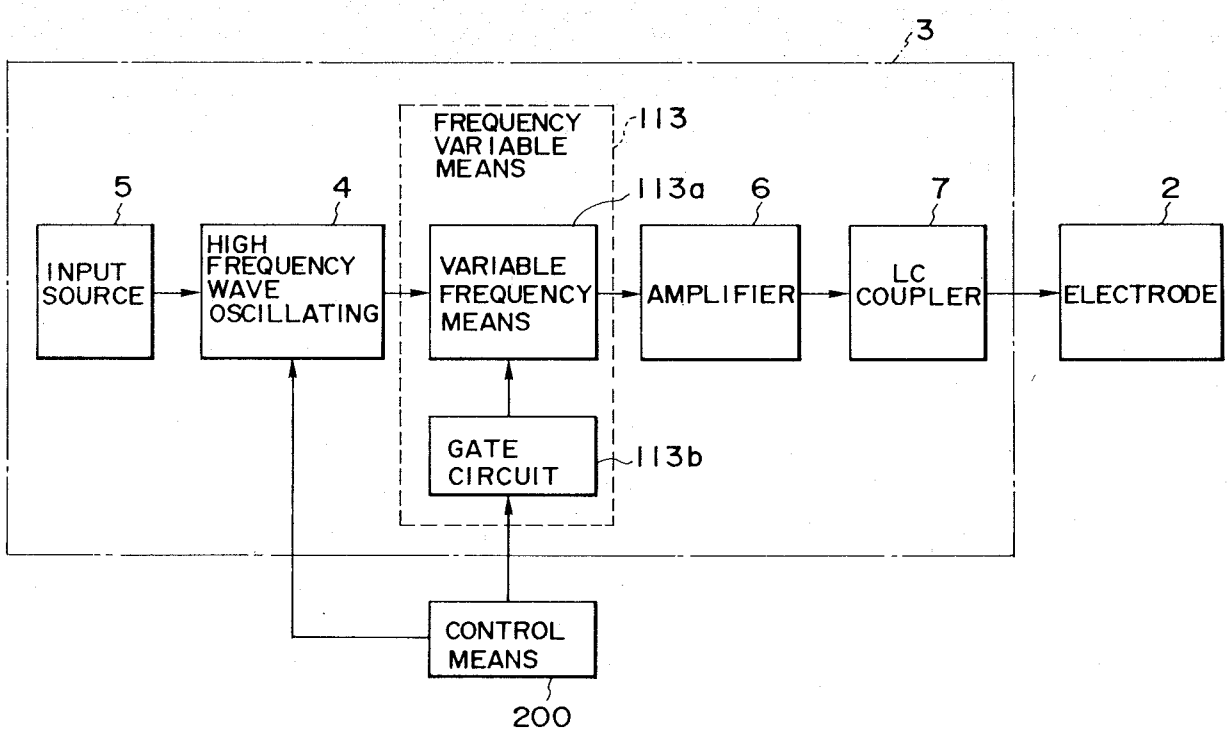

FIG. 24 is a block diagram showing a case where the frequency is fluctuated.

Frequency variable means 113 comprising a variable frequency converter 113*a* well known to those skilled in the art which is provided between the high frequency wave oscillating circuit 4 and the amplifier circuit 6 of high frequency wave applying means 3 and a gate circuit 113*b* connected to the variable frequency converter 113*a* is controlled with the high frequency wave oscillating circuit 4 by control means 200 such as a microprocessor.

The discharge tube and the high frequency output side are made with impedance matching kept therebetween, but a slight aberration occurs in the manufacturing accuracy. Certain problems in the rising-up tend to be aggravated by the impedance difference between the discharge tube and the output side, but there is a certain degree of tolerance. This tolerance can be increased by enhancing the excited state of the discharge starting agent (Hg or the like). Such state is shown in FIG. 25.

Figure 25:
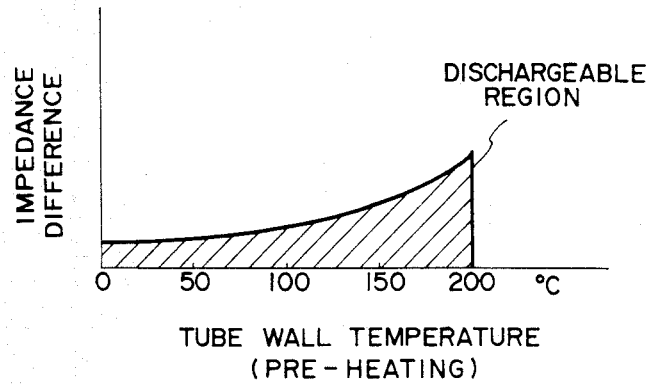
FIG. 25 is an illustration of the present invention.

As shown in FIG. 25, a higher pre-heating temperature is preferable from the viewpoint of widening the tolerance. However, too high a pre-heating temperature would deteriorate the fluorescent material and therefore, 150° C. or lower is preferable.

Figure 26:
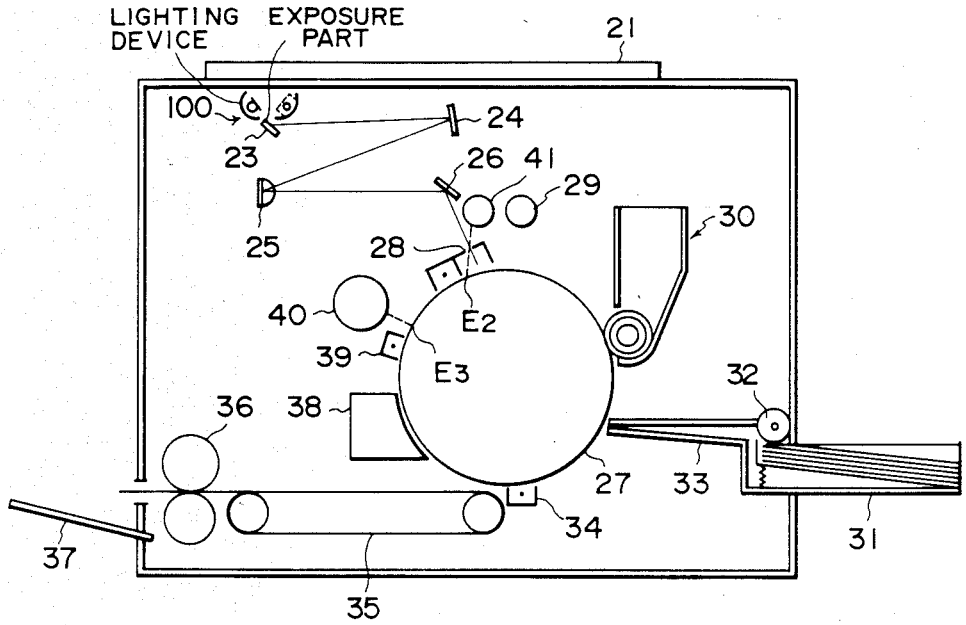
FIG. 26 is a cross-sectional view of a copying apparatus to which the present invention is applied.
Figure 27:
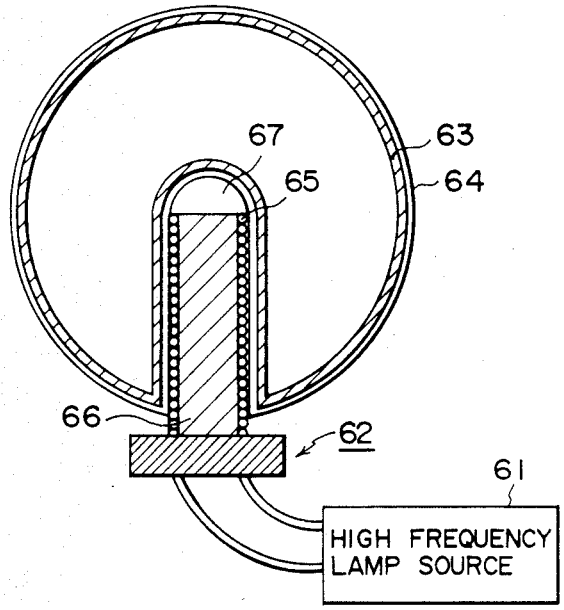
FIG. 27 shows an example of the prior art.
Figure 28:
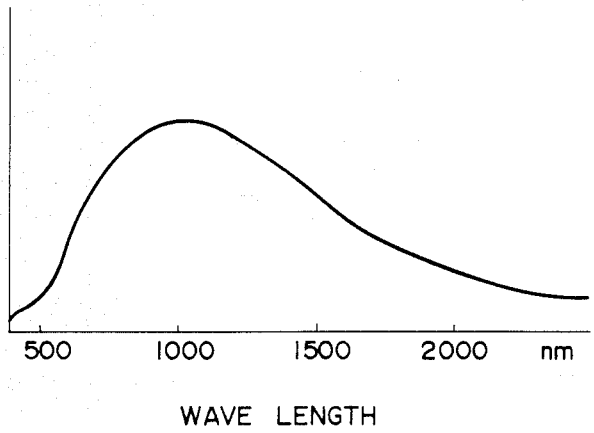
FIG. 28 is an illustration concerned with a halogen lamp.

FIG. 26 is a cross-sectional view of a copying apparatus provided with an original reading apparatus to which the present invention is applied.

In FIG. 26, reference numeral 21 designates an original supporting cover, reference numeral 22 denotes an original exposure device to which the lighting device of the present invention is applied, reference numeral 23 designates a first mirror, reference numeral 24 denotes a second mirror, reference numeral 25 designates an in-mirror lens, and reference numeral 26 denotes a third mirror. An original may be slit-exposed, whereby the optical image thereof may be projected onto a photosensitive drum. Reference numeral 28 designates primary and secondary chargers for forming a latent image on the photosensitive drum having an insulating layer on its surface. The chargers 28 are constructed as a unit. Simultaneously with secondary charging, said optical image is exposed. Further, an electrostatic latent image is formed on the surface of the drum 27 by a whole surface exposure lamp 29. Reference numeral 30 denotes a developing device for visualizing the thus formed latent image.

On the other hand, cut paper sheets as recording materials within a paper supply stacker 31 are fed one by one by a pick-up roller 32 and passes along a paper feed guide 33, and the visible image on the drum 27 is transferred to the cut paper sheet by a transfer charger 34., whereafter the cut paper sheet is conveyed by a conveying unit 35, and at a fixing device 36, the transferred image on the cut paper sheet is fixed, and then the cut paper sheet is discharged onto a paper discharge stacker 37.

Any developer remaining on the drum 27 after the image transfer step is removed by a cleaner 38, whereafter the drum 27 is de-electrified by a charge eliminating device 39 and a charge eliminating lamp 40 to eliminate the electric image remaining on the drum 27, whereby the drum 27 restores its original state. Reference numeral 41 designates a blank exposure lamp for forming the light portion of a latent image to prevent development from being effected during the backward movement of the optical system. E, $E_2$ and $E_3$ denote exposure parts.

During standby, i.e., before a copy signal is input, the discharge tube is pre-heated. When the copy signal is input, the lamp is turned on and scanning of the original is started. During continuous copying, the lamp may remain turned on or may be turned off for each exposure. Also, the temperature of the discharge tube is detected by a temperature sensor, not shown, so that the discharge tube is not pre-heated even during standby if it is at a predetermined temperature or higher. Thus, power consumption is reduced.

Of course, in the present embodiment, the lighting device of the present invention can also be used not only as the original illuminating device but also as the charge eliminating lamp 40 or the blank exposure lamp 41. The photosensitive drum need not always have an insulating layer provided on its surface, and is also applicable to the so-called Carlson process.

Usually, the peak sensitivity of the photosensitive medium is in the range of 400 nm to 800 nm and therefore, it is very effective to irradiate the photosensitive medium with the light from the lighting device of the present invention which produces visible light intensely.

Also, the lighting device for the original exposure is desired to be of high brightness and its wavelength is also desired to be in the visible light range and therefore, the application of the present invention thereto is very effective, and particularly in the original exposure light source of a copying apparatus, it is best suited because it matches the wavelength characteristic of the photosensitive medium as described above.

The present invention has been described above, and it covers any combination of the above-described embodiments.

What is claimed is:

1. A lighting device comprising:
an electrodeless discharge tube adapted to emit light by a high frequency electromagnetic field being applied thereto from outside;
an electrode provided in contact with or in proximity to an outer wall of said discharge tube; and
high frequency wave applying means for applying high frequency power to said electrode, said high frequency wave applying means having means for applying to said electrode, preparatory to causing a substantially complete discharge in said discharge tube, high frequency power of lower level than that applied during the use of said lighting device, for heating said discharge tube.

2. A lighting device according to claim 1, wherein said high frequency wave applying means outputs a voltage lower than that during the use of said lighting device before said lighting device is used.

3. A lighting device according to claim 1, wherein said high frequency wave applying means outputs a current lower than that during the use of said lighting device before said lighting device is used.

4. A lighting device according to claim 1, wherein said discharge tube is of an elongated shape.

5. A lighting device according to claim 4, wherein said lighting device is an exposure source for slit-exposing an original used in an original reading apparatus.

6. A lighting device according to claim 1, wherein said high frequency wave has a frequency in a range of $10^6$–$10^8$ Hz.

7. A lighting device according to claim 4, wherein a plurality of said electrodes are provided along the lengthwise direction of said discharge tube.

8. A lighting device comprising:
an electrodeless discharge tube adapted to emit light by a high frequency electromagnetic field being applied thereto from outside;
an electrode provided in contact with or in proximity to an outer wall of said discharge tube; and
high frequency wave applying means for applying high frequency power to said electrode, said high frequency wave applying means applying to said electrode high frequency power of such a level that said discharge tube does not discharge, while said lighting device is in a standby state.

9. A lighting device according to claim 8, wherein said discharge tube is of an elongated shape.

10. A lighting device according to claim 9, wherein said lighting device is an exposure source for slit-exposing an original used in an original reading apparatus.

11. A lighting device according to claim 8, wherein said high frequency wave applying means applies to said electrode a voltage of such a level that said discharge tube does not discharge during the standby of said lighting device.

12. A lighting device according to claim 8, wherein said high frequency wave applying means applies to said electrode a current of such a level that said discharge tube does not discharge during the standby of said lighting device.

13. A lighting device according to claim 8, wherein said high frequency wave has a frequency in a range of $10^6$–$10^8$ Hz.

14. A lighting device comprising:

an electrodeless tube adapted to emit light by a high frequency electromagnetic field being applied thereto from outside;

an electrode provided in contact with or near said discharge tube; and high frequency wave applying means for applying high frequency power to said discharge tube, said high frequency wave applying means applying a first high frequency power to said electrode while said lighting device is in a standby state, applying a second high frequency power to said electrode at an initial stage of a use of said lighting device, and thereafter applying a third high frequency power to said electrode, the second high frequency powers the second high frequency power being greater than the third high frequency power and the third high frequency power being greater than the first high frequency power, the first high frequency power heating said discharge tube without essentially discharging, and the second and third high frequency powers discharging said discharge tube.

15. A lighting device according to claim 14, wherein said high frequency wave applying means is variable in voltage, and first, second and third high frequency voltages are in the relation that the second high frequency voltage is greater than the third high frequency voltage which is greater than the first high frequency voltage.

16. A lighting device according to claim 14, wherein said high frequency wave applying means is variable in current, and first, second and third high frequency current are in the relation that the second high frequency current is greater than the third high frequency current which is greater than the first high frequency current.

17. A lighting device according to claim 14, wherein said high frequency wave applying means is variable in duty ratio, and the duty ratios of the first, second and third high frequency powers are in the relation that the duty ratio of the second high frequency power is greater than the duty ratio of the third high frequency lower which is greater than the duty ratio of the first high frequency power.

18. A lighting device according to claim 14, wherein said high frequency wave has a frequency in a range of $10^6$–$10^8$ Hz.

19. A lighting device according to claim 14 wherein said discharge tube is of an elongated shape.

20. A lighting device according to claim 19, wherein said lighting device is an exposure source for slit-exposing an original used in an original reading apparatus.

21. A lighting device according to claim 14, wherein the second high frequency power is 1.5 to 3 times as great as the third high frequency power.

* * * * *

UNITED STATES PATENT AND TRADEMARK OFFICE

CERTIFICATE OF CORRECTION

PATENT NO. : 4,798,997

DATED : January 17, 1989

INVENTOR(S) : HIDEMI EGAMI ET AL.

It is certified that error appears in the above-identified patent and that said Letters Patent is hereby corrected as shown below:

COLUMN 6

Line 42, "to to" should read --not to--.

COLUMN 14

Line 19, "lower" should read --power--.

Signed and Sealed this

Twelfth Day of September, 1989

*Attest:*

DONALD J. QUIGG

*Attesting Officer*

*Commissioner of Patents and Trademarks*